US005167198A

United States Patent [19]

Bonnet

[11] Patent Number: 5,167,198

[45] Date of Patent: Dec. 1, 1992

[54] DEVICE FOR HOISTING A SAIL TAUT

[76] Inventor: Claude Bonnet, rue des Vals, F-42160, Andrezieux-Boutheon, France

[21] Appl. No.: 460,347

[22] PCT Filed: Sep. 12, 1989

[86] PCT No.: PCT/FR89/00459

§ 371 Date: Jun. 18, 1990

§ 102(e) Date: Jun. 18, 1990

[87] PCT Pub. No.: WO90/02684

PCT Pub. Date: Mar. 22, 1990

[30] Foreign Application Priority Data

Sep. 13, 1988 [FR] France ..... 88 12292

[51] Int. Cl.[5] ..... B63H 9/10

[52] U.S. Cl. ..... 114/111; 114/102

[58] Field of Search ..... 114/102, 103, 39.1, 114/361, 104, 105, 106, 107, 108, 109, 111, 112

[56] References Cited

U.S. PATENT DOCUMENTS 2,856,879 10/1958 Baker ..... 114/39.1
3,841,251 10/1974 Larson ..... 114/39.1
4,803,939 2/1989 Jones ..... 114/102

*Primary Examiner*—Sherman Basinger
*Assistant Examiner*—Thomas J. Brahan
*Attorney, Agent, or Firm*—Eckert Seamans Cherin & Mellott

[57] ABSTRACT

A device for hoisting the sail of a sailing boat has a track mounted on a support extending transversely across the deck of a boat. A sliding mechanism engages with the track and is slidable to and fro the length of the track. A clew of the sail is fixed to the slide allowing the sail to be orientated without a need for a boom. The height of the track is adjustable for adjusting the belly and twist of the sail.

7 Claims, 5 Drawing Sheets

DEVICE FOR HOISTING A SAIL TAUT

The invention relates to the technical sector of sailing boat riggings.

In general, on sailing boats, the main sail or the sails such as the foresails, are hoisted taut along their foot by a boom. The sail is orientated in function of the orientation of the wind by operating the boom angularly by means of a sheet which is belayed, firstly, on the said boom and secondly, on the sliding slide. This slide is mounted so as to slide on a component known as a deck horse transversally fixed along the centre line of the boat.

This deck horse can be fixed either directly onto the deck or on a support mounted underneath the boom. Therefore, it seems that the clew of the sail situated substantially at the free end of the boom, is arranged substantially above the deck. In all cases, a boom is required in order to hoist taut the foot of the sail and orientate it. However, the disadvantages involved when using a boom are known. In fact, besides the fact that the boom may turn out to be dangerous during certain operations, it takes up considerable room on the deck and limits the position of the tacks.

The invention is aimed at overcoming these disadvantages in a simple, safe and efficient manner.

In order to overcome the problem brought up of being able to eliminate the boom, whilst aiming at clearing the deck a maximum, the device is outstanding in that it comprises a support transversally arranged along the centre line of the boat and designed with means likely to belay the sheet at the rear of the clew of the sail and above the deck of the boat by eliminating the boom and capable of movement of the said sheet in function of the orientation of the sail.

In order to overcome another problem of being able to adjust the belly and twist of the sail, the track is mounted on the support capable of height adjustment. In one embodiment, the track can be mounted on part of the support designed to be adjustable in height.

In order to overcome another problem of being able to offset the sheet slide from one side to the other and outside the freeboard of the boat, the track is made out of two parts one of which is mounted so as to be fixed onto part of the support whereas the other is mounted capable of guided sliding and movement with respect to the said first part, the slide being mounted on the mobile part of the track.

In an advantageous manner, the support is made up of a bow. According to another feature, the top cross member of the bow is fitted with a transversal coiler taking a rain awning.

The invention is described below in more detail accompanied by the following attached drawings in which.

The object of the invention will become more apparent from the following non-limitating description when referring to the embodiments in the figures of the drawings.

The device according to the invention is designed to belay the sheet (E) at the rear of the clew (E1) of the sail (V) and above the deck of the boat (P). With this in mind, the device comprises at least one support (1) transversally arranged along the centre line of the boat and at the rear of the clew (E1).

The support (1) is likely to provide the heightwise mounting, above the deck, of a track (2) taking, in a free sliding and position adjustable manner, a slide (3) designed to belay the sheet at the rear of the clew. The sheet track (2) may be rectilinear or bent. In a preferred manner, the support is made up of a bow.

Figure 1:
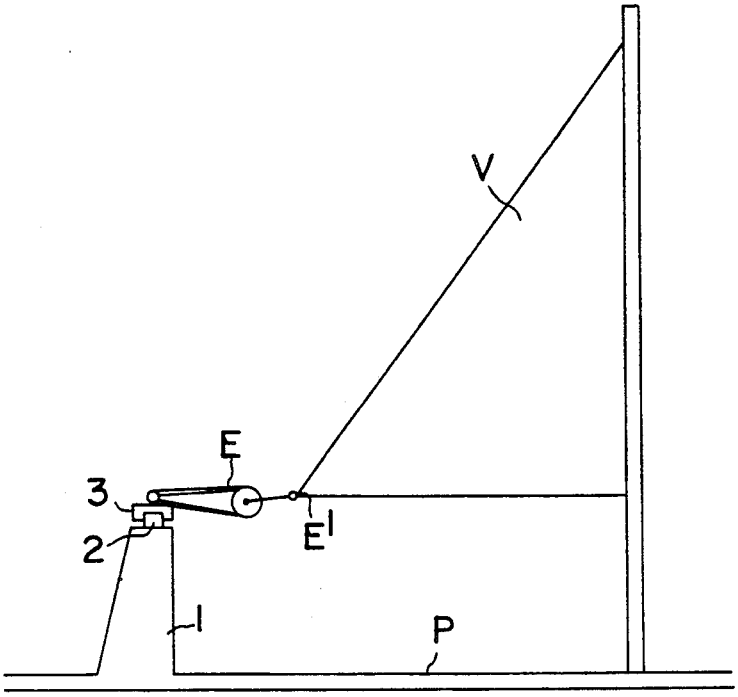
FIGS. 1 and 2 are purely schematic views showing two possibilities for hoisting taut a sail according to the device of the invention.
Figure 2:
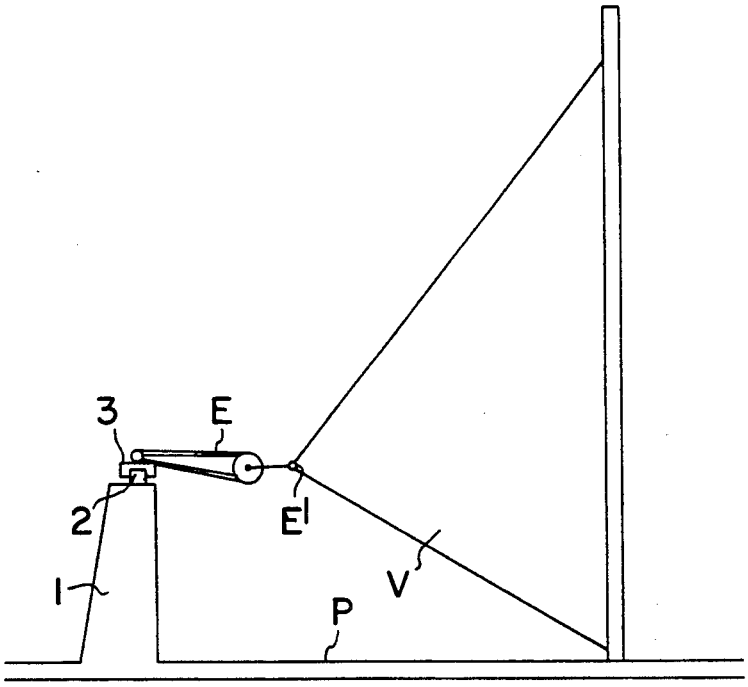
Figure 3:
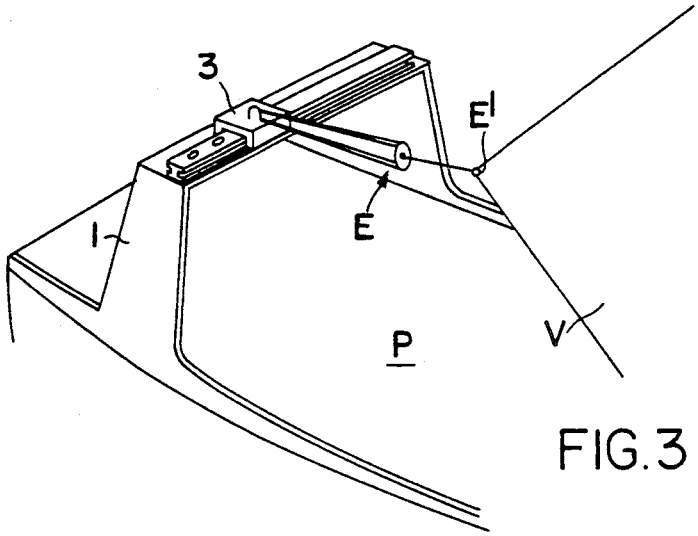
FIG. 3 is a partial, perspective view of the device.

Given these conditions, the device enables, in the case of a clew moving to a high point above the deck, the feet to be hoisted taut and the sail to be orientated without having to use a boom (FIGS. 1 and 2).

In order to be able to adjust the belly and twist of the sail, it is important to be able to adjust the sheet track (2) in height. Several solutions comprising means for adjusting a vertical position of the slide may be envisaged.

Figure 4:
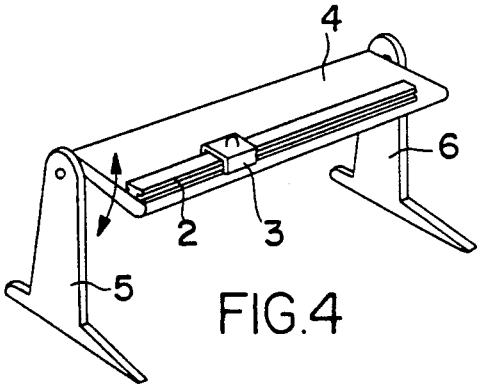
FIGS. 4, 5 and 6 are perspective views showing different embodiments of the support designed to provide height adjustment of the sheet track.
Figure 5:
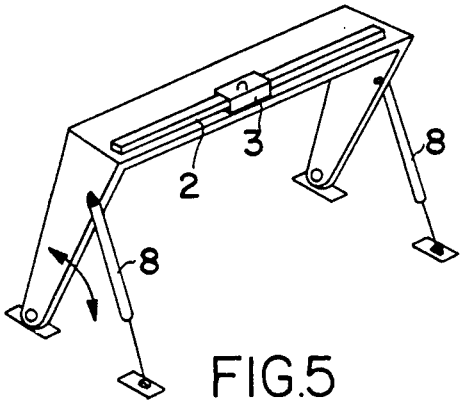
Figure 6:
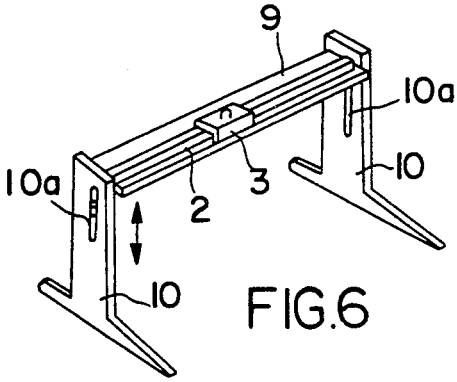

In FIGS. 4 to 6, part of the support is designed to provide height adjustment of the sheet track (2). In FIG. 4, the means for adjusting includes the track (2) which is fixed onto a horizontal wing (4) hinged at both ends, capable of angular orientation and locking in position, on two fixed support components (5) and (6). This track (2), takes, as shown, the sheet pulling point slide (3).

In FIG. 5, the means for adjusting includes the track (2) which is fixed onto a support (7) mounted so as to be capable of orientating angularly with respect to the deck of the boat, thereby being fitted with two cylinders (8). The slide (3) is mounted onto the track (2).

In FIG. 6, the means for adjusting includes the track (2) which is fixed onto a horizontal wing (9) mounted so as to be adjustable in height in combination with two vertical slots (10*a*) each having two support components (10) fixed onto the deck.

Figure 7:
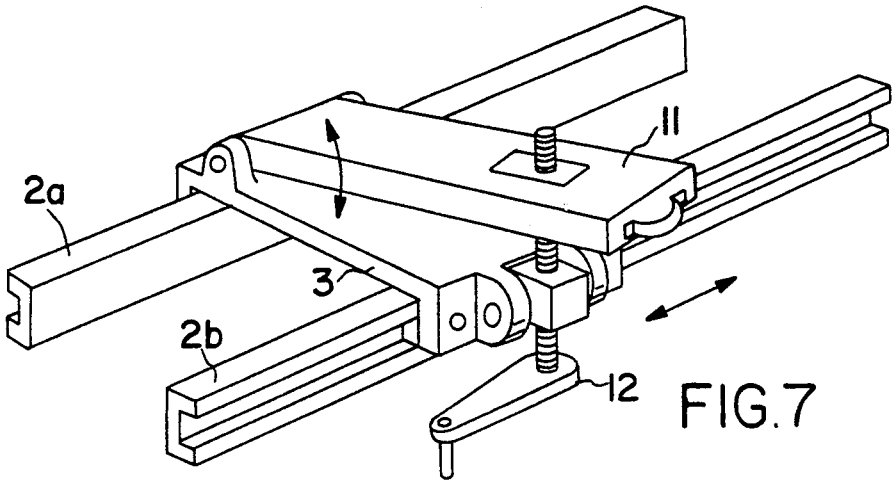
FIGS. 7 and 8 are perspective views illustrating other means for the height adjustment of the sheet pulling point.
Figure 8:
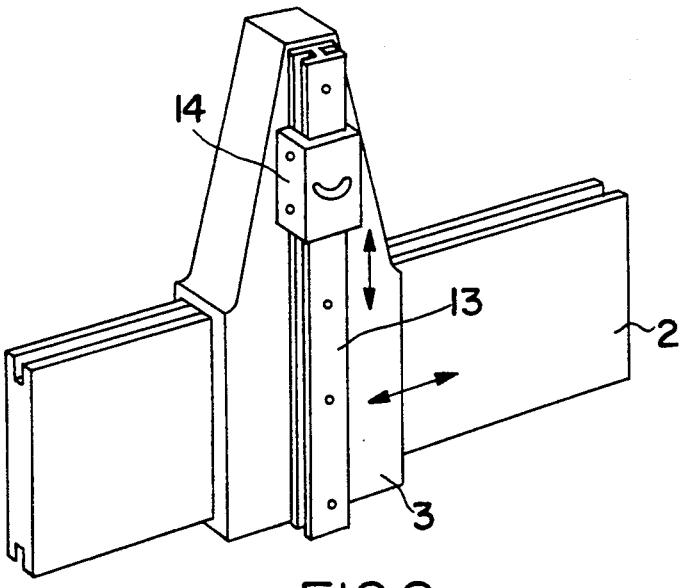
Figure 9:
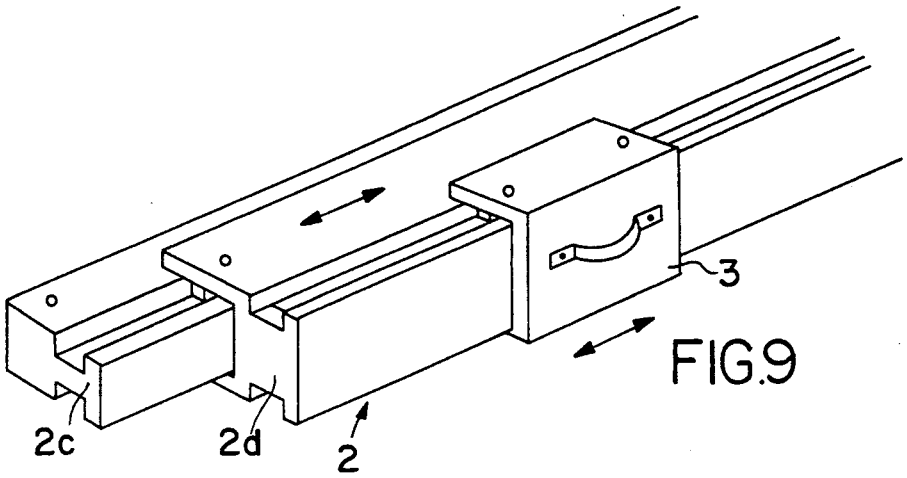
FIG. 9 is a perspective view of another embodiment of the device.
Figure 10:
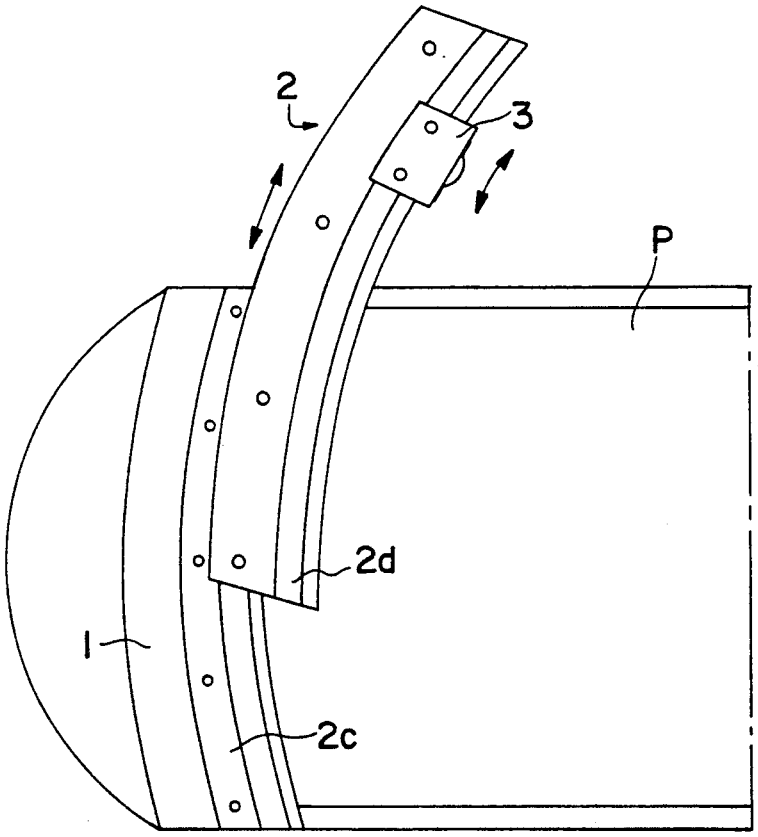
FIG. 10 is a partial plan view of a boat fitted with the device according to FIG. 9.
Figure 11:
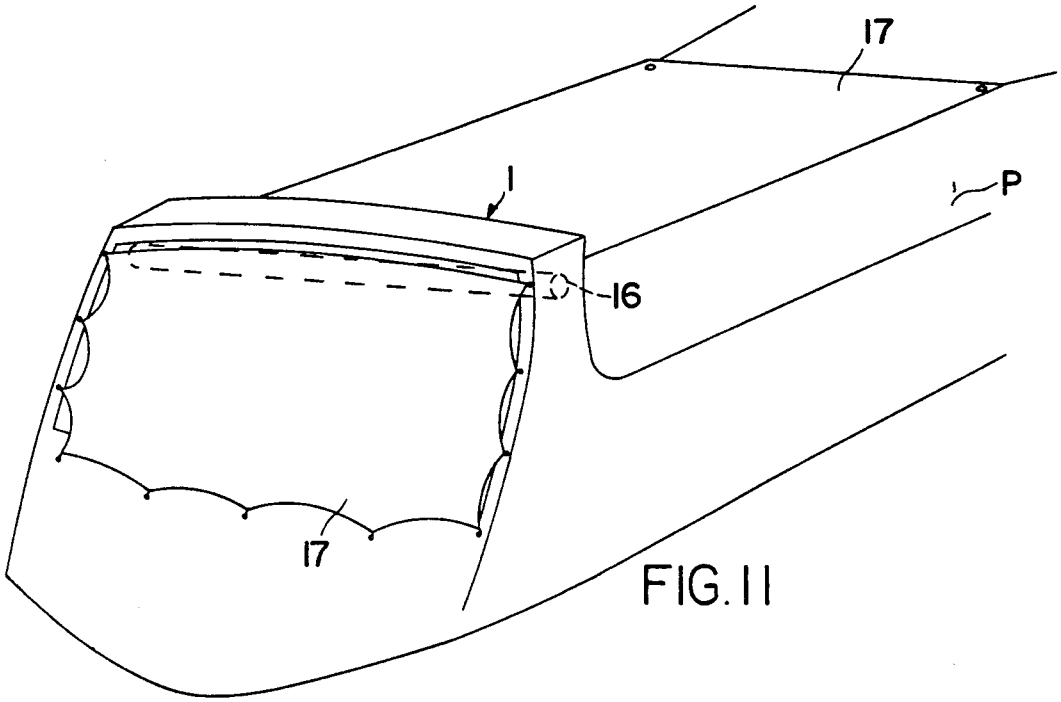
FIGS. 11 and 12 are perspective views of other alternative forms of embodiment.
Figure 12:
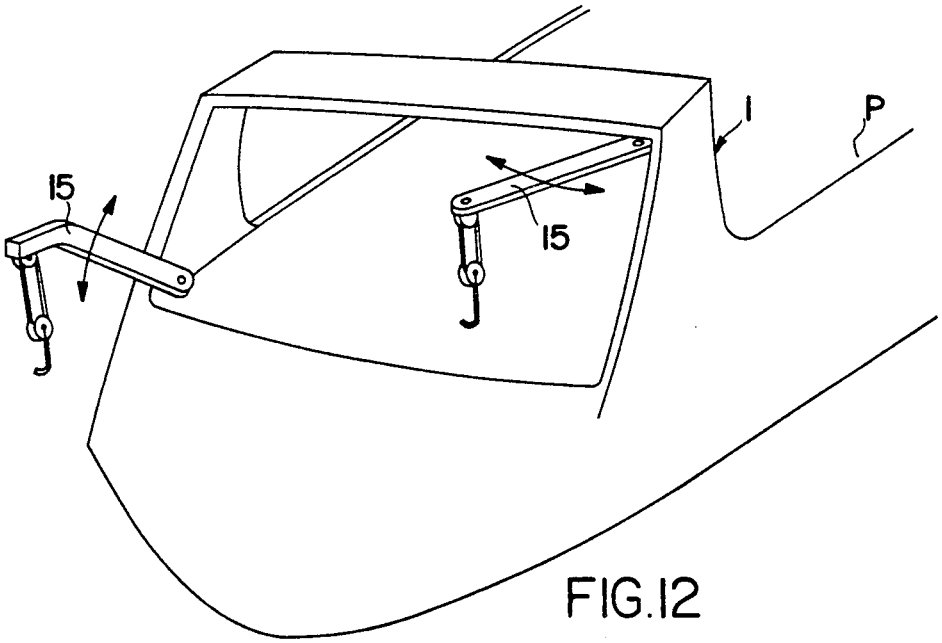

In the embodiment in FIGS. 7 and 8, the slide (3) sliding on the track (2) is fixed directly or by built up means to provide height adjustment of the clew, including in a plane perpendicular to the transversal movement of the slide.

In FIG. 7, the means for adjusting includes the sheet track (2) which is made of 2 independent, fixed parts (2*a*) and (2*b*), designed to provide, in combination, the sliding mounting of the slide (3). A component (11) is hinged onto the slide (3). This component is fixed to a device (12) likely to provide its angular adjustment and hold it in position. The component (11) is designed to take the sheet pulling point.

In FIG. 8, the means for adjusting includes the sheet track (2) which takes the slide (3) so as to freely slide on which a secondary track (13) is fixed vertically to enable the sliding movement of a block (14) taking the sheet pulling point.

It is also planned, according to the invention, to be able to transversally move the sheet slide (3), from one side to the other and outside the freeboard of the boat. With this in mind, the track (2) is made up of two parts (2c) and (2d) one of which (2c) is fixed whereas the other is mounted capable of moving with respect to the said first fixed part (2c). The mobile track part (2d) takes the slide (3) so as to freely slide.

It is to be noted that the support bow (1) can be fitted with arms (15) swivelling in a vertical and/or horizontal plane, the said arm(s) being possibly fitted with tackles or suchlike systems for handling and/or mooring operations of an ancillary boat. Similarly, the top cross member of the bow, can take a coiler (16) to fit a rain awning (17) above the deck. It is to be noted that the rain awning can be partially unrolled and fixed substantially vertically in combination with the support (1) to act as a sail likely to provide rear wind exposure.

I claim:

1. A device to hoist taut a sail of a sailing boat, the boat having a deck, a longitudinal axis of the boat defining a center line, the sail having a clew, comprising:
- a pair of vertical supports attached to the boat;
- a horizontal wing attached between the vertical supports, the wing defining a horizontal track, said track disposed above the deck and extending transversely to the center line of the boat;
- a slide movable along the track;
- adjusting means connected for adjusting a vertical position of the slide with respect to the deck, including the wing being pivotal on a horizontal axis whereby the track is vertically movable;
- means for maintaining a vertical location of the track with respect to the deck; and,
- connecting means attached between the clew and the slide for moving the sail in response to movement of the slide.

2. A device to hoist taut a sail of a sailing boat, the boat having a deck, a longitudinal axis of the boat defining a center line, the sail having a clew, comprising:
- a support hingedly mounted on the deck of the boat, the support defining a horizontal track, said track disposed above the deck and extending transversely to the center line of the boat;
- a slide movable along the track;
- adjusting means connected for adjusting a vertical position of the slide with respect to the deck, including extensible cylinder means for pivoting the support with respect to the deck; and,
- connecting means attached between the clew and the slide for moving the sail in response to movement of the slide.

3. A device to hoist taut a sail of a sailing boat, the boat having a deck, a longitudinal axis of the boat defining a center line, the sail having a clew, comprising:
- a pair of vertical supports attached to the boat;
- a horizontal wing attached between the vertical supports, the wing defining a horizontal track, said track disposed above the deck and extending transversely to the center line of the boat;
- a slide movable along the track;
- adjusting means connected for adjusting a vertical position of the slide with respect to the deck, including a vertical slot defined in each of the vertical supports, the wing being vertically adjustable within the slots; and,
- connecting means attached between the clew and the slide for moving the sail in response to movement of the slide.

4. A device to hoist taut a sail of a sailing boat, the boat having a deck, a longitudinal axis of the boat defining a center line, the sail having a clew, comprising:
- a first horizontal support which is fixed with respect to the deck;
- a second horizontal support movable along the first horizontal support, the second horizontal support defining a horizontal track, said track disposed above the deck and extending transversely to the center line of the boat;
- a slide movable along the track;
- adjusting means connected for adjusting a vertical position of the slide with respect to the deck; and,
- connecting means attached between the clew and the slide for moving the sail in response to movement of the slide.

5. A device to hoist taut a sail of a sailing boat, the boat having a deck, a longitudinal axis of the boat defining a center line, the sail having a clew, comprising:
- a support attached to the boat, the support defining a horizontal track, said track disposed above the deck and extending transversely to the center line of the boat;
- a slide movable along the track, the slide including a pivoting component having a free end;
- adjusting means connected for adjusting a vertical position of the slide with respect to the deck, including screw means attached for adjusting a vertical position of the free end; and
- connecting means attached between the clew and the free end of the slide for moving the sail in response to movement of the slide.

6. A device to hoist taut a sail of a sailing boat, the boat having a deck, a longitudinal axis of the boat defining a center line, the sail having a clew, comprising:
- a support attached to the boat, the support defining a horizontal track, said track disposed above the deck and extending transversely to the center line of the boat;
- a slide movable along the track, the slide defining a secondary track extending vertically;
- adjusting means connected for adjusting a vertical position of the slide with respect to the deck, including a block movable along the secondary track; and
- connecting means attached between the clew and the block for moving the sail in response to movement of the block.

7. A device to hoist taut a sail of a sailing boat, the boat having a deck, a longitudinal axis of the boat defining a center line, the sail having a clew, comprising:
- a support attached to the boat, the support defining a horizontal track, said track disposed above the deck and extending transversely to the center line of the boat;
- a slide movable along the track;
- adjusting means connected for adjusting a vertical position of the slide with respect to the deck;
- connecting means attached between the clew and the slide for moving the sail in response to movement of the slide;
- a cylindrical roll rotatably attached to the support; and,
- a flexible awning wound around the cylindrical roll, whereby the flexible awning can be unwound from the cylindrical roll to provide a protective cover.

* * * * *